US006666753B2

(12) United States Patent
McHale, Jr. et al.

(10) Patent No.: US 6,666,753 B2
(45) Date of Patent: Dec. 23, 2003

(54) SILVER-COATED ABRASIVES, TOOLS CONTAINING SILVER-COATED ABRASIVES, AND APPLICATIONS OF THESE TOOLS

(75) Inventors: James M. McHale, Jr., Worthington, OH (US); James H. Dailey, Westerville, OH (US); Markus Jacobuss, Columbus, OH (US); Daniel R. Riehle, Powell, OH (US); Juergen Von Dungen, Buerstadt (DE)

(73) Assignee: General Electric Company, Pittsfield, MA (US)

( * ) Notice: Subject to any disclaimer, the term of this patent is extended or adjusted under 35 U.S.C. 154(b) by 0 days.

(21) Appl. No.: 09/776,141

(22) Filed: Feb. 2, 2001

(65) Prior Publication Data

US 2002/0164931 A1 Nov. 7, 2002

(51) Int. Cl.[7] ..... B24D 11/00

(52) U.S. Cl. ..... 451/48; 451/36; 451/41; 451/304; 51/295; 419/11; 428/172

(58) Field of Search ..... 451/36, 48, 41, 451/304, 307, 28; 51/295, 307, 309, 304; 428/172, 469, 552, 697–699; 75/236, 238, 242; 419/11, 15, 18, 26, 30, 32, 34, 53

(56) References Cited

U.S. PATENT DOCUMENTS

| | | | | |
|---|---|---|---|---|
| 4,403,001 A | | 9/1983 | Grenier | |
| 4,521,222 A | | 6/1985 | St. Pierre et al. | |
| 4,944,773 A | | 7/1990 | Rue et al. | |
| 6,086,648 A | * | 7/2000 | Rossetti, Jr. et al. | 451/28 |
| 6,251,149 B1 | * | 6/2001 | Meyer et al. | 51/295 |
| 6,261,329 B1 | * | 7/2001 | Ogata et al. | 419/11 |
| 6,270,393 B1 | * | 8/2001 | Kubota et al. | 450/41 |
| 6,299,992 B1 | * | 10/2001 | Lindskog et al. | 419/11 |

FOREIGN PATENT DOCUMENTS

EP 0065690 12/1982

* cited by examiner

*Primary Examiner*—Joseph J. Hail, III
*Assistant Examiner*—Anthony Ojini

(57) ABSTRACT

Flute grinding cemented carbide workpieces with a diamond containing resin bond grinding wheel is improved by restricting the diamond to comprise a silver-coated diamond; conducting the grinding in the presence of a lubricant consisting of only straight oil; and conducting the grinding at a wheel speed of less than about 30 m/s and preferably about 20 m/s. The preferred diamond is coated with about 25% and 75% silver by weight.

19 Claims, 6 Drawing Sheets

SILVER-COATED ABRASIVES, TOOLS CONTAINING SILVER-COATED ABRASIVES, AND APPLICATIONS OF THESE TOOLS

CROSS REFERENCE TO RELATED APPLICATIONS

None.

STATEMENT REGARDING FEDERALLY SPONSORED RESEARCH

Not applicable.

BACKGROUND OF THE INVENTION

Cemented tungsten carbide is a very difficult material to machine. Grinding of round tools, such as drills and end mills is even more demanding as tight tolerances are often required on the finished part. In flute grinding, a specially contoured grinding wheel is used to translate the required shape of the flute to the workpiece. As the wheel wears away during the grinding operation, the size of the flutes cut from the workpiece will change. When this wheel wear becomes excessive, it is necessary to reshape the grinding wheel by dressing. Dressing is counterproductive in that it requires downtime and removal of otherwise useful material from the grinding wheel. A grinding wheel with a higher grinding ratio (defined as volume of workpiece removed per volume of grinding wheel removed) will retain its shape for a longer time, increasing the amount of material that can be removed before the wheel shape deteriorates to the point at which dressing is required. Any improvement that can be made in the number of flutes that can be ground between dressing intervals is directly translated into productivity for the toolmaker. This productivity is realized through less downtime (labor savings) and more finished pieces per grinding wheel (material savings).

Grinding round tools with superabrasive grinding wheels has mainly relied on standard techniques and frequent dressing of the wheel to maintain the desired contours on the finished part. Some operational methods have been patented, such as U.S. Pat. No. 4,186,529 and U.S. Pat. No. 4,115,95, which describe a programmably controlled method for grinding end-cutting tools. This invention utilizes a grinding wheel wear compensation program to compensate for the loss of dimensional tolerance.

A method for applying silver coatings to diamond is described in U.S. Pat. No. 4,403,001. Electroless application of a silver coating to diamond particles, and a composite coating of silver and nickel is described in U.S. Pat. No. 4,521,222. Resin-bonded grinding elements with dual coated diamond grit for dry grinding and wet grinding cemented carbide workpieces. The patents do not report the great benefits achieved with the use of silver-coated abrasives in combination straight oil coolants and low wheel speeds in grinding of round tools, as reported herein.

BRIEF SUMMARY OF THE INVENTION

Resin bond grinding wheels containing silver-coated diamond have shown excellent performance in specific carbide grinding applications. Unexpectedly, it was found that the full benefits of the silver coating are only realized under certain grinding conditions. Thus, flute grinding cemented carbide workpieces with a diamond containing resin bond grinding wheel is improved by restricting the diamond to comprise a silver-coated diamond; conducting the grinding in the presence of a lubricant of only straight oil; and conducting the grinding at a wheel speed of less than about 30 m/s and preferably about 20 m/s. Preferred diamond is coated with about 25% and 75% silver by weight.

BRIEF DESCRIPTION OF THE DRAWINGS

For a fuller understanding of the nature and advantages of the present invention, reference should be had to the following detailed description taken in connection with the accompanying drawings, in which.

Figure 1:
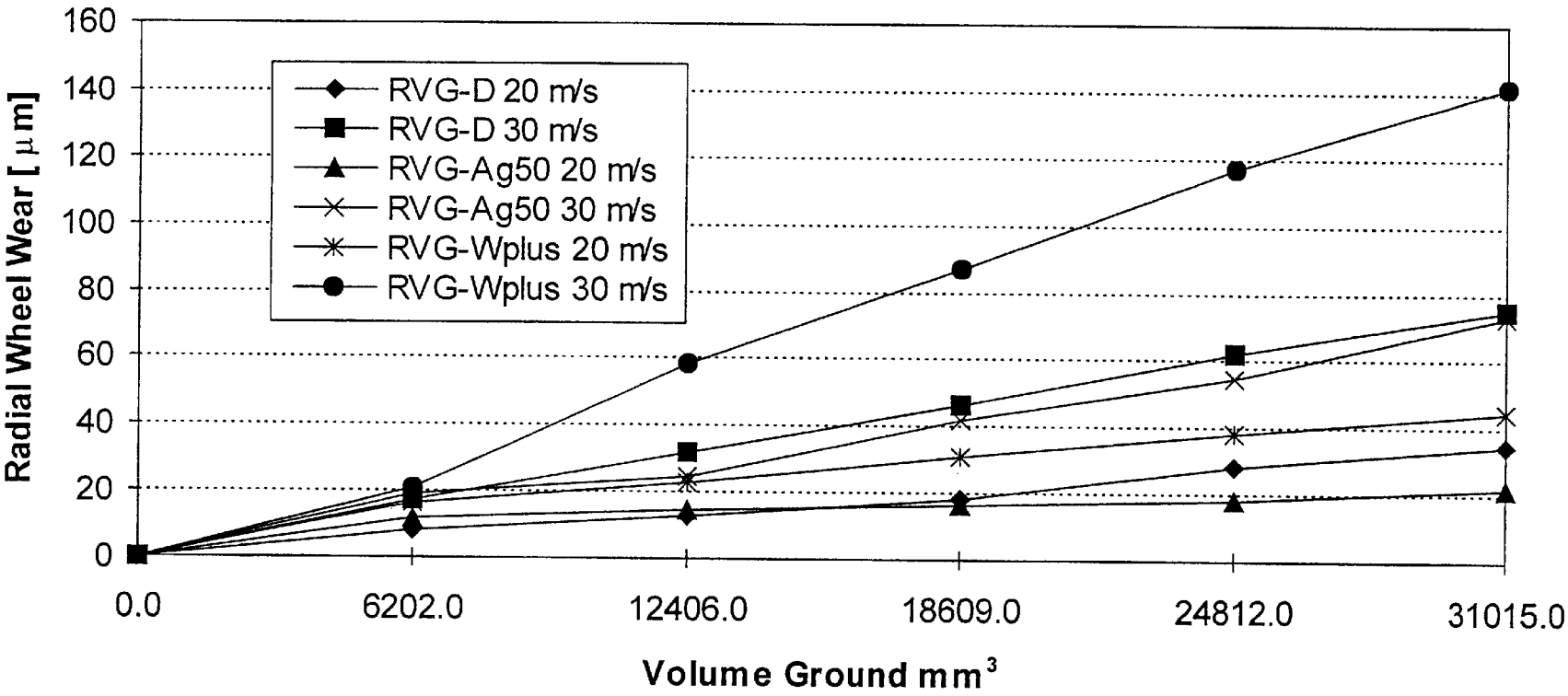
FIG. 1 is a graph of the radial wheel wear versus volume ground in creep grinding of WC, as reported in Table 3 of Example 1.

The drawings will be described in greater detail below.

DETAILED DESCRIPTION OF THE INVENTION

Superior performance can be achieved in grinding cemented carbide (e.g., cemented WC) with silver-coated diamond (typically, 25%–75% silver by weight) in a resin-bonded (e.g., phenolic or polyimide bonded) grinding wheel at low wheel speeds (~20 m/s) and a straight oil coolant. The increased wheel life is especially beneficial in grinding operations where dimensional control on the workpiece is of high importance, such as flute grinding on round tools.

While any silver-coated diamond grit is believed to be useful in the present invention, the preferred silver-coated diamond is RVG-Ag50 diamond (GE Superabrasives, Worthington, Ohio). This silver-coated diamond is described as having a diamond base crystal that is a friable irregular shaped crystal that has been coated with 50 weight-% of silver. The product also is described as having coating spikes that mechanically retain the crystal in the bond.

The diamond particles can be natural or synthetic. Synthetic diamond most often is used in grinding operations. Synthetic diamond can be made by high pressure/high temperature (HP/HT) processes, which are well known in the art.

The resin most frequently used in resin bond grinding wheels is a phenol-formaldehyde reaction product. However, other resins or organic polymers may be used, such as, for example, melamine or urea formaldehyde resins, epoxy resins, polyesters, polyamides, and polyimides. Concentration of coated diamond and fabrication of such wheels is conventional and well known in that art.

Grinding wheels can be disc shape or cup shape and can contain a secondary distribution of silicon carbide or other secondary abrasive particles without detrimentally affecting the performance of the grinding element containing the silver coated diamond particles. In a typical preparation of a resin bond grinding wheel, a mixture of granulated resin, Ag coated diamond abrasive particles, and filler is placed in a mold. A pressure appropriate to the particular resin, usually several thousand pounds per square inch (several tens of thousands of Kilo Pascals, KPa), is applied, and the mold is heated to a temperature sufficient to make the resin plastically deform (and cure when the resin is heat-curable).

The cemented metal carbide substrate subjected to the fluted grinding operation is conventional in composition and, thus, may include any of the Group IVB, VB, or VIB metals, which are pressed and sintered in the presence of a binder of cobalt, nickel or iron, or alloys thereof. Tungsten carbide most often is the metal carbide preferred by tool manufacturers.

Coolants used in carbide grinding operations typically are oil-based. These cooling oils are either water-soluble or water insoluble. Tests conducted during the development of the present invention revealed that "straight oils" are distinctly preferred in order to achieve the unexpected benefits reported herein. "Straight oils", as such term is used in the carbide grinding industry, refers to water insoluble oils, as typified by mineral oil. A variety of other petroleum oils also are used in the industry and can be used to advantage in the inventive grinding operation disclosed herein.

Unexpected, it was discovered that when flute grinding carbide workpieces using straight oils, that resin bond wheels containing silver-coated diamond abrasive provide superior performance. Such performance is measured by longer wheel life and reduced energy input. Thus, grinding ratios are markedly higher for the inventive wheels than for wheels containing diamond coated with other metals. Moreover, such improved performance is realized at lower grinding wheel speeds. Below about 30 m/s the improved benefits start to become apparent and are truly exhibited at around 20 m/s. The examples will amply demonstrate such improved grinding performance.

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application all units are in the metric system and all amounts and percentages are by weight, unless otherwise expressly indicated. Also, all citations referred herein are expressly incorporated herein by reference.

EXAMPLES

Example 1

Two sets of grinding tests were performed to study the effectiveness of silver-coated abrasives in grinding round tools. The first round of tests included three grinding wheels supplied by Landis Gardner CITCO Operations. The purpose of the tests was to determine grinding wheel performance variations caused by different metal coatings on RVG (See fn. 1, Table 3) diamond. Tungsten carbide grade K420 served as workpiece material and in a creep feed grinding mode.

Grinding tests were performed on the four-axis Huffman machine using 1A1 wheels. The wheel specifications are listed in Table 1.

TABLE 1

| Wheel Specifications | |
|---|---|
| Wheel Type | 1A1 |
| Abrasive | RVG-Ag50, RVG-D, RVG-Wplus |
| Wheel Diameter ($d_s$) | 177.8 mm (7.0 in.) |
| Wheel Width ($b_s$) | 6.55 mm (¼ in.) |
| Mesh Size | 200/230 |
| Concentration | 100 |
| Wheel Manufacturer | Landis Gardner CITCO Operations |
| Bond Type | Resin |

Prior to grinding, the wheel surfaces were prepared with a brake controlled truing device. Each wheel was trued employing a silicon-carbide wheel (37C60-MVK) in a rough and a finish/truing mode. Rough truing used infeed increments of 13 $\mu$m/pass (0.0005 in/pass) and finish truing used infeed increments of 2.5 $\mu$m/pass (0.0001 in/pass). Upon completion of the truing operation, the wheels were dressed by plunging into a soft aluminum-oxide stick (9A240G9V82) at 0.2 m/min (8 ipm.). A total of 6.6 $cm^3$ (0.4 $in^3$) of dressing stick was consumed to expose the diamonds.

Five individual tests were run with each wheel under the conditions shown in Table 2. Castrol Ilogrind 600 straight oil served as coolant. The workpiece material was tungsten carbide grade K420 as described in Table 2. During each grinding test measurements of grinding power were taken and stored on a personal computer. Radial wheel wear and surface finish measurements were obtained from wheel profiles generated in tungsten carbide coupons using a Hommel-T4000 profilometer.

TABLE 2

| Grinding Test Conditions | |
|---|---|
| Machine | Four-Axis Huffman Grinder HS-154, 14 kW (18.7 hp) |
| Grinding Mode | Creep Feed Grinding (upcut) |
| Wheel Speed ($v_s$) | 20 m/s (3938 SFPM)<br>25 m/s (4920 SFPM)<br>30 m/s (5906 SFPM)<br>40 m/s (7872 SFPM) |
| Table Speed ($v_w$) | 0.076 m/min (3 ipm.) |
| Depth of Cut ($a_e$) | 1.25 mm (0.050 in.) |
| Width of Cut ($b_D$) | 3.28 mm (0.129 in.) |
| Workpiece Material | Kennametal Tungsten Carbide Block K420, HRA 91.2 |
| Workpiece Size (l × w × h) | 51.0 mm × 19.5 mm × 76.0 mm (2 in. × 0.768 in. × 3.0 in.) |
| Spec. Mat. Remov. Rate ($Q'_w$) | 1.56 $mm^3$/mm/s (0.15 $in.^3$/in./min.) |
| Coolant | Castrol Ilogrind 600 Straight Oil |

The overall creep feed grinding test results are shown in Table 3 for grinding ratio (G), grinding power (P), and workpiece surface finish ($R_a$).

TABLE 3

Creep Feed Grinding Test Results

| Diamond Abrasive Type[1] | Volume Ground $V_w$ [$mm^3$] | Wheel Speed [m/s] | Radial Wheel Wear $\Delta_{rs}$ [$\mu$m] | Grinding Ratio G | Power P [kW] | Specific Power P [kW/mm] | Surface Finish $R_a$ [$\mu$m] |
|---|---|---|---|---|---|---|---|
| RVG-D | 31015 | 20 | 34.8 | 486.5 | 1.9 | 0.6 | 0.22 |
| RVG-D | 31015 | 30 | 75.4 | 224.6 | 2.5 | 0.8 | 0.36 |
| RVG-Ag50 | 31015 | 20 | 21.9 | 773.1 | 2.9 | 0.9 | 0.17 |
| RVG-Ag50 | 31015 | 25 | 63.2 | 267.9 | 1.9 | 0.6 | 0.29 |
| RVG-Ag50 | 31015 | 30 | 73.0 | 232.0 | 2.6 | 0.8 | 0.27 |
| RVG-Ag50 | 12406 | 40 | 67.2 | 100.8 | 4.1 | 1.3 | 0.11 |
| RVG-Wplus | 31015 | 20 | 44.9 | 377.1 | 2.5 | 0.8 | 0.25 |
| RVG-Wplus | 31015 | 30 | 142.1 | 119.2 | 2.6 | 0.8 | 0.27 |

[1]RVG diamond (56 weight-% nickel coating (RVG-Wplus), 50 weight-% copper coating (RVG-D), and 50 weight-% silver coating (RVG-Ag50); see, RVG Diamond. GE's Guideline to Markets and Applications", GE Superabrasives, Worthington, OH USA).

Figure 2:
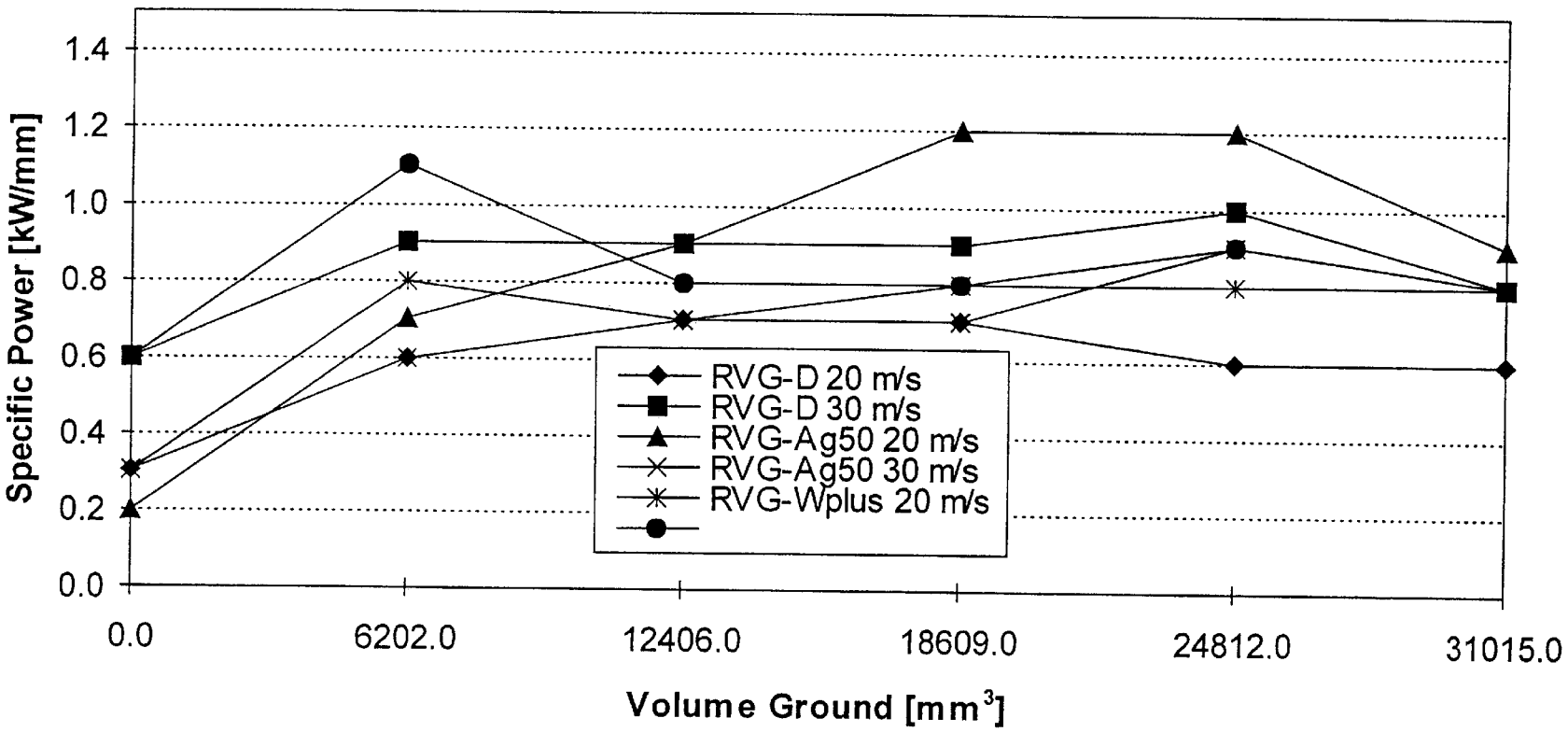
FIG. 2 is a graph of the specific power versus volume ground in creep grinding of WC, as reported in Table 3 of Example 1.
Figure 3:
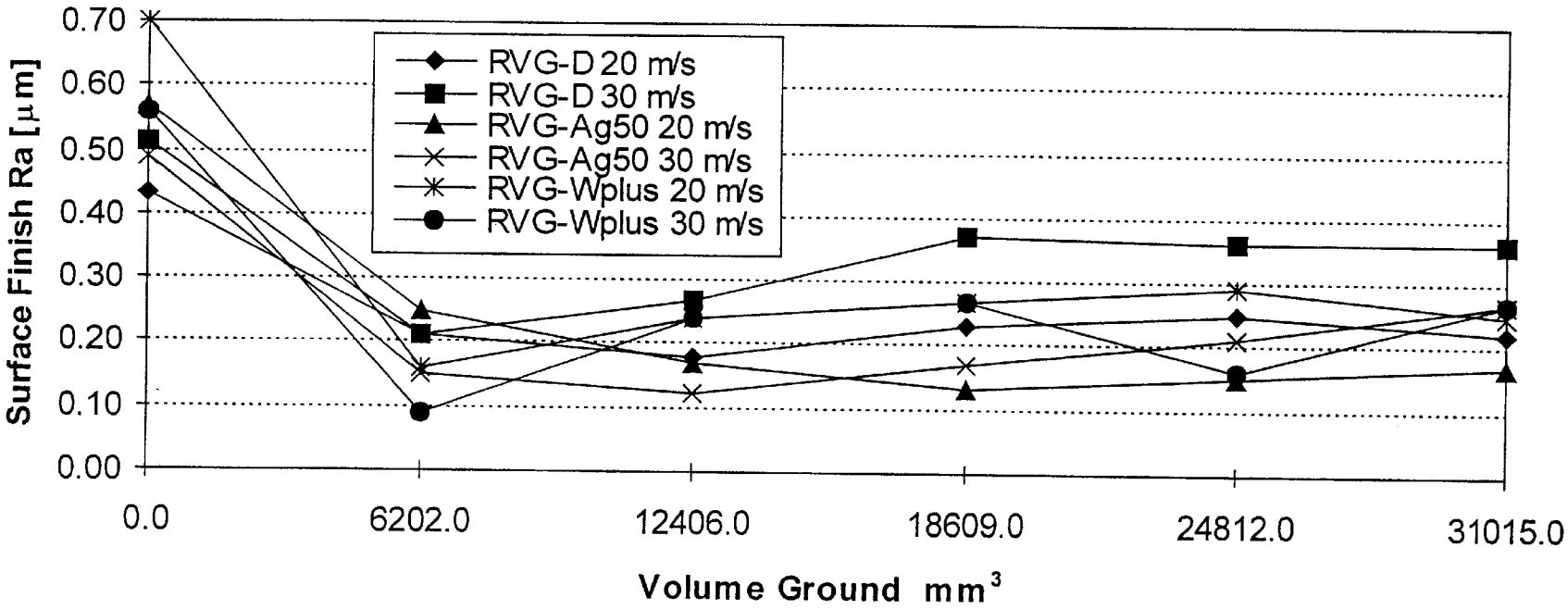
FIG. 3 is a graph of the surface finish versus volume ground in creep grinding of WC, as reported in Table 3 of Example 1.
Figure 4:
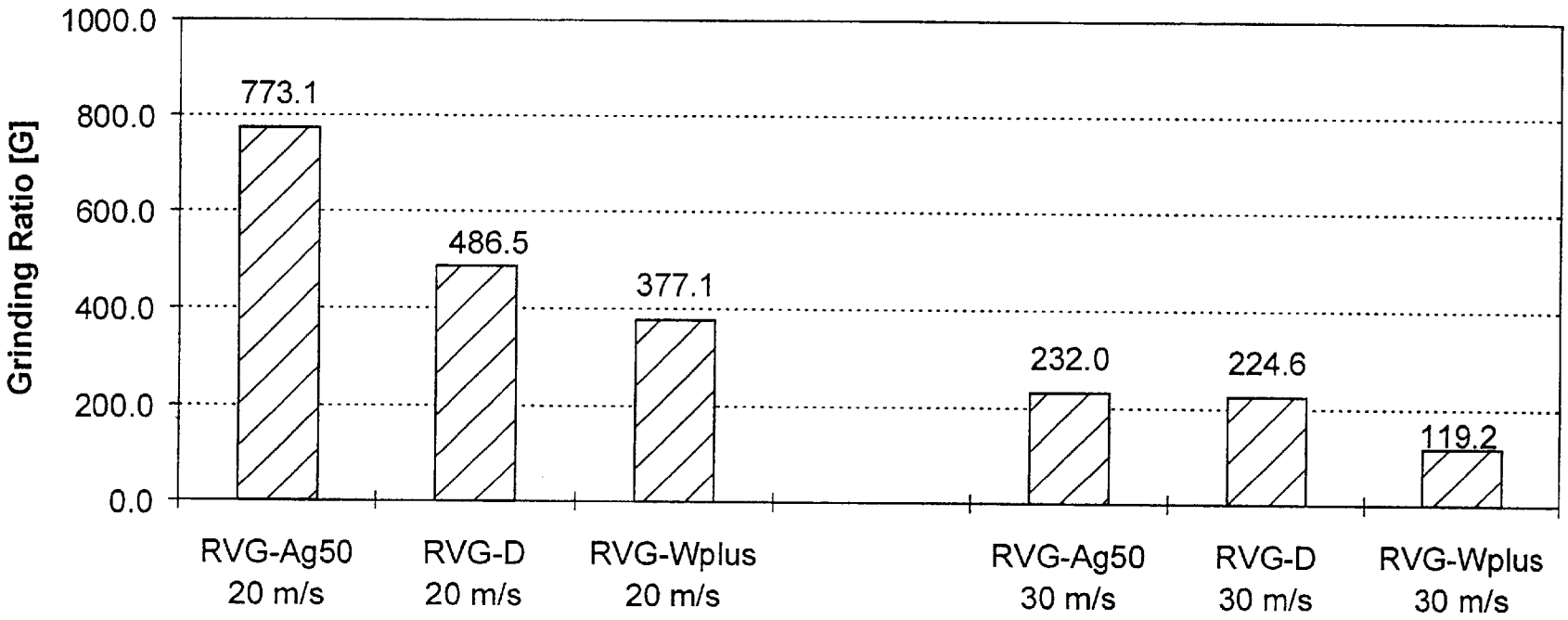
FIG. 4 is graph of the overall grinding ratio at 20 and 30 m/s wheel speed in creep grinding of WC, as reported in Table 3 of Example 1.
Figure 5:
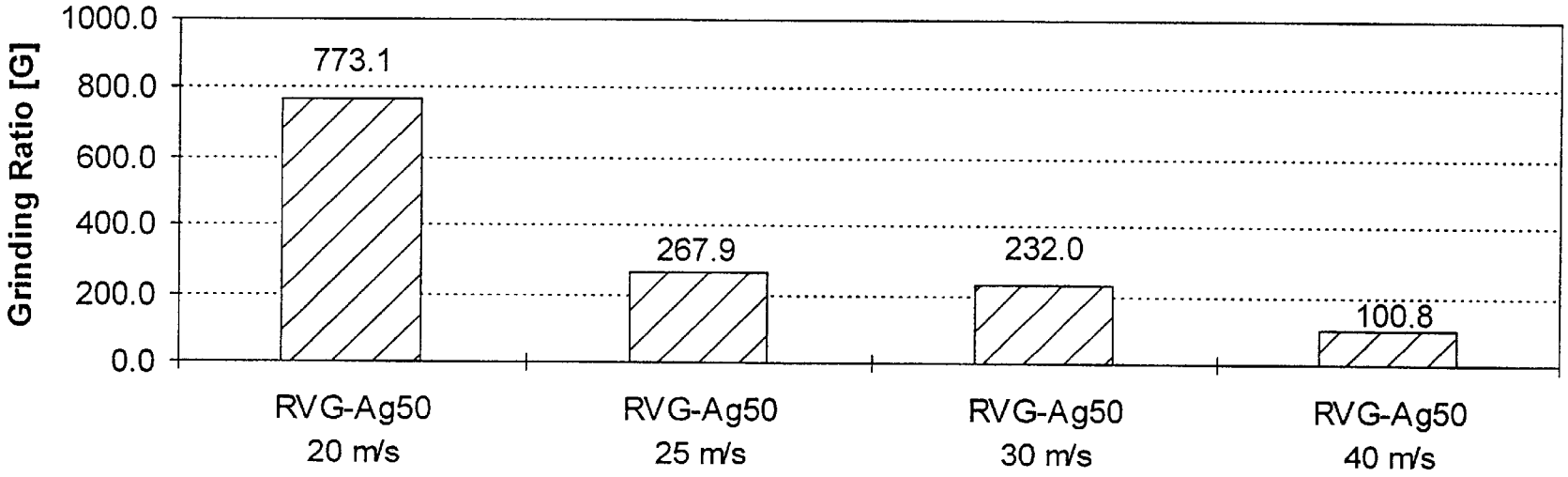
FIG. 5 is a graph of the grinding ratio versus wheel speed for the silver coated diamond grinding wheel.

FIGS. 1, 2, and 3 are graphs, showing the performance of the different wheels during the progress of testing with regard to radial wheel wear, grinding power, and workpiece surface finish. FIG. 4 shows the overall grinding ratio of each diamond type when the tests were conducted at 20 and 30 m/s. FIG. 5 shows the results of testing on the RVG-Ag50 grinding wheel at 20, 25, 30 and 40 m/s. The depth of cut (1.25 mm [0.050"]) and the traverse rate (0.076 m/min [3.0 ipm]) were kept constant throughout all the tests. This produced a specific material removal rate of $Q'_w$=1.56 $mm^3$/mm/s (0.15 $in^3$/in/min.)

Initial testing at 30 m/s showed that the copper and silver-coated crystals produced essentially equal results, which were approximately twice the wheel life of the nickel coated crystal. By far the best grinding ratio of 773.1 was achieved with the wheel containing RVG-Ag50, followed by the RVG-D wheel at 486.5 and the RVG-Wplus wheel at 377.1 with the wheel speed at 20 m/s. These tests show that matching the correct wheel speed and abrasive type can improve wheel life by more than 6×.

FIG. 3 compares the workpiece surface finish, $R_a$, obtained with the three grinding wheels. The resulting roughness values for workpieces ground with the three wheels were between $R_a$=0.11 $\mu$m and $R_a$=0.36 $\mu$m. Usually, higher wheel speeds produce a better surface finish. The opposite was found during these tests as the diamond crystals were retained longer in the resin bonds at lower wheel speeds thereby producing better finishes.

The conclusions based on this data are:

Outstanding grinding performance can be achieved by using a silver-coated abrasive in combination with low wheel speeds and a straight oil coolant.

Slight changes in wheel speed dramatically effect the grinding ratio. Changing wheel speed from 25 to 20 m/s increased the grinding ratio from 267.9 to 773.1 for the wheel containing RVG-Ag50.

The tests at 20 m/s produced surface finishes ranging from 0.17 to 0.25 $\mu$m $R_a$, while the tests at 30 m/s had surface finishes between 0.27 to 0.36 $\mu$m $R_a$.

Tests using RVG-Ag50 conducted at 40 m/s generated excessive wheel wear and had very high power requirements.

Example 2

Additional testing was performed using 60 weight-% spiked nickel coating (RVG-WS60), standard 56 weight-% nickel coating (RVG-W), 50 weight-% copper coating (RVG-D), and 50 weight-% silver coating (RVG-Ag50). Tungsten carbide, grade K20F, was used as workpiece material in a creep feed flute grinding operation. The grinding tests were performed on a WALTER Helitronic Power Production grinding machine. The wheel data, workpiece specifications, grinding conditions, and machine specifications are detailed below

TABLE 4

Wheel Data

| | |
|---|---|
| Wheel type | 1A1 |
| Wheel No. | 6164, 6169, 6183, 6167 |
| Wheel Size (mm) | 100 × 15 × 5 |
| Abrasive Type | RVG-WS60, RVG-W, RVG-D, RVG-Ag50 |
| Abrasive Size | 230/270 |
| Concentration | 100 |
| Bond | Polyimide, type W-plus 3060 |

TABLE 5

Workpiece specifications

| | |
|---|---|
| Material | Tungsten carbide |
| Type | K20F, 90% WC |
| Size | Ø 20 × 112 mm |
| Grinding length | 50 mm |
| No. of flutes | 3 |
| Material removed/endmill | 5.318 $cm^3$ |
| Helix | 30°–35° |
| Hardness (HRA) | 92 |

TABLE 6

Grinding Conditions

| | |
|---|---|
| Wheel speed ($v_s$) | 18 m/s |
| Feed rate ($v_{fr}$) | 80 mm/min |
| Depth of cut ($a_e$) | 4.5 mm |
| Coolant | Straight oil (Syntogrind HM, Fa. Oel Held) |
| Coolant flow rate ($q_{kss}$) | 120 l/min at 20 bar |
| Grinding Mode | Creep feed flute grinding |
| Max. material removal rate ($Q'_{wmax}$) | 5.9 $mm^3$/mm/s |

Prior to grinding, the wheels were trued with a silicon carbide wheel and dressed with an aluminum oxide stick. Four endmilis were ground with each grinding wheel. Following the trend in the industry towards shorter cycle times to improve productivity, severe process conditions were chosen. The conditions resulted in a material removal rate of $Q'_{wmax}$=5.9 $mm^3$mm/s. A straight oil served as coolant. During each grinding test, the relative spindle torque was monitored and recorded. Radial wheel wear measurements were obtained by tracing the grinding wheel surface with a diamond stylus. The following data was recorded.

TABLE 7

| Wheel No. | 6164 | | | 6169 | | | 6183 | | | 6167 | | |
|---|---|---|---|---|---|---|---|---|---|---|---|---|
| Abrasive Type | RVG-WS60 | | | RVG-W | | | RVG-D | | | RVG-Ag 50 | | |
| Abrasive Size | 230/270 | | | 230/270 | | | 230/270 | | | 230/270 | | |
| Endmills ground (three flutes each) | 4 | | | 4 | | | 4 | | | 4 | | |
| Torque measured on | Flute No. | | | Flute No. | | | Flute No. | | | Flute No. | | |
| grinding spindle (%) | 1 | 2 | 3 | 1 | 2 | 3 | 1 | 2 | 3 | 1 | 2 | 3 |
| Endmill No. 1 | 65 | 65 | 65 | 60 | 65 | 65 | 60 | 65 | 70 | 60 | 65 | 65 |
| Endmill No. 2 | 65 | 65 | 65 | 70 | 105 | 75 | 54 | 54 | 70 | 65 | 70 | 75 |
| Endmill No. 3 | 70 | 70 | 70 | 75 | 75 | 80 | 120 | 70 | 70 | 70 | 70 | 70 |
| Endmill No. 4 | 70 | 70 | 75* | 80 | 80 | * | 75 | 75 | 75 | 75 | 75 | 80 |
| Material removed ($V_w$) ($cm^3$) | 21.271 | | | 19.500 | | | 21.271 | | | 21.271 | | |
| Wheel wear ($\Delta V_s$) ($cm^3$) | 0.179 | | | 0.162 | | | 0.204 | | | 0.130 | | |
| G-Ratio** | 119 | | | 120 | | | 104 | | | 163 | | |

*Workpiece breakage

**G-Ratio = $V_w/\Delta V_s$, where the wheel wear $\Delta V_s$ was calculated by multiplying the triangular shaped worn area of the wheel by the circumference of the wheel.

Figure 6:
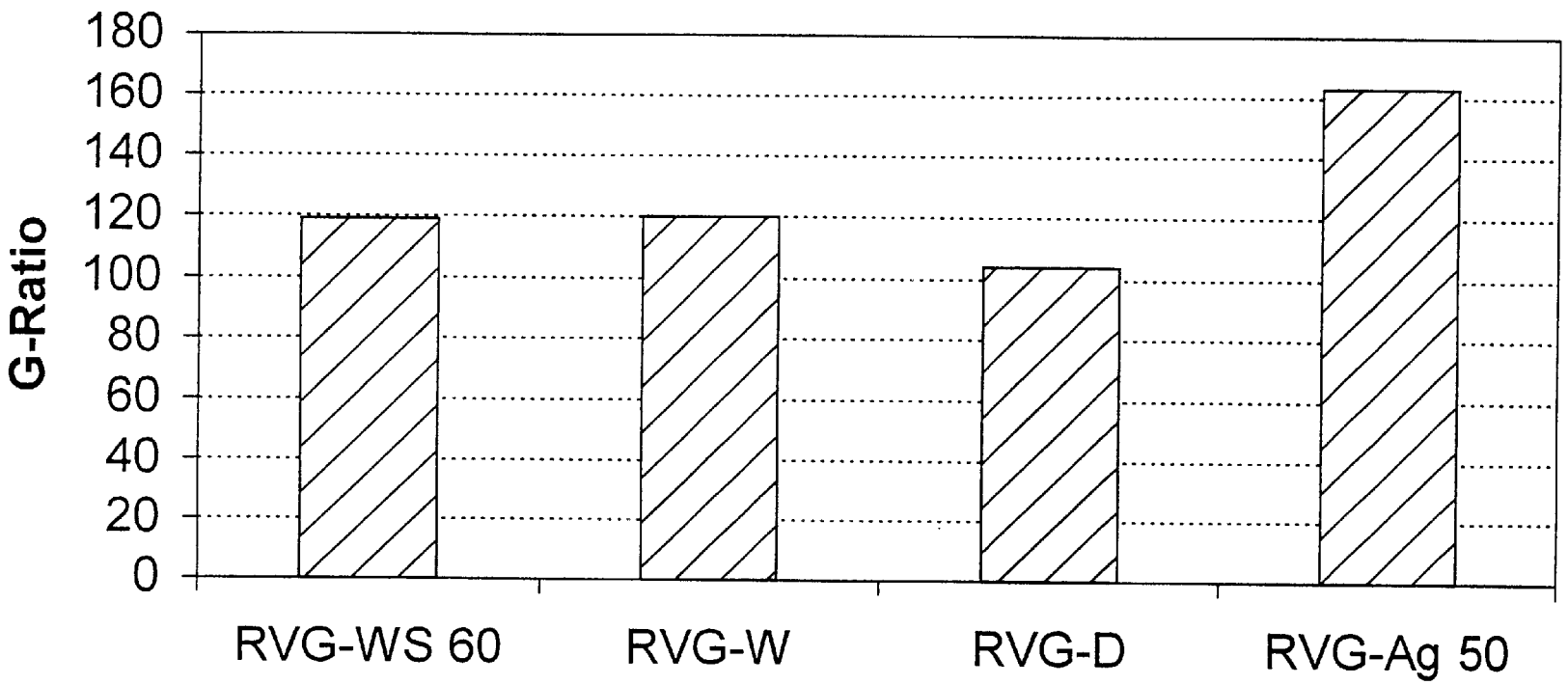
FIG. 6 is graph of the grinding ratios versus volume ground in creep grinding of WC, as reported in Table 7 of Example 2.

The grinding ratios are plotted in FIG. 6. It has been evaluated that the type of diamond coating is directly impacting the grinding behavior described by power consumption and wheel wear (G-Ratio).

Grinding the first endmill, there was no significant difference in power consumption. During grinding the second set of endmills, the wheel containing RVG-W abrasive showed a significant peak in power consumption (105%), which indicates an in-stationary re-sharpening process of the grinding wheel. A similar effect was observable with the wheel containing RVG-D (120%) abrasive as well.

The grinding wheels with RVG-WS60 and RVG-Ag50 showed a more stable process with a small and constant increase of the power drawn during the test.

Of all wheels tested, the wheel containing RVG-Ag50 achieved the highest G-ratio value (36% higher than RVG-WS60 and RVG-W). The wheel containing RVG-D showed the lowest tool life. The wheels containing RVG-WS60 and RVG-W abrasive generated also a chattering noise at the end of the tests and were causing a workpiece breakage at the fourth endmill respectively.

The reason for these effects could be, that also at a comparable power consumption, which is directly related to the tangential grinding force, the normal grinding force of the process could have increased and caused chatter and workpiece breakage.

Of all wheels tested, the wheel containing RVG-Ag50 abrasive showed the best free cutting characteristics in terms of abrasive protrusion and minimized wheel loading tendency by an improved friction behavior of the wheel topography by the silver coating.

What is claimed is:

1. In a method for grinding cemented carbide workpieces with a resin bond grinding wheel comprising silver-coated diamond, said method comprising the steps:

(a) conducting said grinding in the presence of a lubricant consisting essentially of a straight oil; and (b) conducting said grinding at a wheel speed of less than about 30 m/s.

2. The method of claim 1, wherein said diamond contains between about 25% and 75% silver coating by weight.

3. The method of claim 2, wherein said diamond contains about 50% silver coating by weight.

4. The method of claim 1, wherein said straight oil comprises a mineral oil.

5. The method of claim 1, wherein said wheel speeds are about 20 m/s.

6. The method of claim 1, wherein said resin bond grinding wheel is formed from one or more of a phenol-formaldehyde reaction product, a melamine or urea formaldehyde resin, an epoxy resin, a polyester, a polyamide, or a polyimide.

7. The method of claim 6, wherein said resin bond grinding wheel is one or more of a phenol-formaldehyde reaction product or a polyimide.

8. The method of claim 1, wherein said cemented carbide workpiece includes one or more of a Group IVB, VB, or VIB metal, which is pressed and sintered in the presence of a binder of one or more of cobalt, nickel, iron, or alloys thereof.

9. The method of claim 8, wherein said cemented carbide workpiece comprises WC.

10. The method of claim 9, wherein said WC workpiece is cemented with Co.

11. The method of claim 1, wherein said grinding is flute grinding.

12. The method of claim 1, wherein said grinding is creep feed grinding.

13. In a method for grinding cemented carbide workpieces with a resin bond grinding wheel comprising silver-coated diamond, said method comprising the steps:

(a) conducting said grinding in the presence of a lubricant consisting essentially of a mineral oil; and (b) conducting said grinding at a wheel speed of less than about 30 m/s;

wherein said silver-coated diamond is coated with between about 25% and 75% silver by weight.

14. The method of claim 13, wherein said wheel speed is about 20 m/s.

15. The method of claim 13, wherein said resin bond grinding wheel is formed from one or more of a phenol-formaldehyde reaction product, a melamine or urea formaldehyde resin, an epoxy resin, a polyester, a polyamide, or a polyimide.

16. The method of claim 15, wherein said resin bond grinding wheel is one or more of a phenol-formaldehyde reaction product or a polyimide.

17. The method of claim 13, wherein said cemented carbide workpiece includes one or more of a Group IVB, VB, or VIB metal, which is pressed and sintered in the presence of a binder of one or more of cobalt, nickel, iron, or alloys thereof.

18. The method of claim 17, wherein said cemented carbide workpiece comprises WC.

19. The method of claim 18, wherein said WC workpiece is cemented with Co.

* * * * *